US009857050B2

(12) United States Patent
Bobbo et al.

(10) Patent No.: US 9,857,050 B2
(45) Date of Patent: Jan. 2, 2018

(54) LIGHTING DEVICE

(71) Applicant: OSRAM GmbH, Munich (DE)

(72) Inventors: Simon Bobbo, Chirignago (IT); Alessandro Scordino, Dolo (IT)

(73) Assignee: OSRAM GmbH, Munich (DE)

( * ) Notice: Subject to any disclaimer, the term of this patent is extended or adjusted under 35 U.S.C. 154(b) by 217 days.

(21) Appl. No.: 14/722,181

(22) Filed: May 27, 2015

(65) Prior Publication Data

US 2015/0345733 A1 Dec. 3, 2015

(30) Foreign Application Priority Data

Jun. 3, 2014 (IT) ..... TO2014A0442

(51) Int. Cl.

| | |
|---|---|
| ***F21V 3/04*** | (2006.01) |
| ***F21V 17/10*** | (2006.01) |
| ***F21V 17/16*** | (2006.01) |
| ***F21V 17/00*** | (2006.01) |
| *F21V 15/01* | (2006.01) |
| *F21V 31/00* | (2006.01) |
| *F21Y 105/10* | (2016.01) |
| *F21Y 115/10* | (2016.01) |
| *F21V 3/02* | (2006.01) |

(52) U.S. Cl.

CPC ..... *F21V 3/0427* (2013.01); *F21V 17/002* (2013.01); *F21V 17/10* (2013.01); *F21V 17/164* (2013.01); *F21V 3/02* (2013.01); *F21V 15/01* (2013.01); *F21V 31/005* (2013.01); *F21Y 2105/10* (2016.08); *F21Y 2115/10* (2016.08)

(58) Field of Classification Search

CPC ..... F21V 3/0427; F21V 17/002; F21V 17/10; F21V 17/164; F21V 3/02; F21V 15/01; F21V 31/005; F21Y 2105/10; F21Y 2115/10

See application file for complete search history.

(56) References Cited

U.S. PATENT DOCUMENTS

| | | | | |
|---|---|---|---|---|
| 8,643,043 | B2 * | 2/2014 | Shimizu | F21S 8/04 257/88 |
| 2010/0246181 | A1 | 9/2010 | Fang et al. | |
| 2011/0141745 | A1 | 6/2011 | Gu et al. | |

(Continued)

FOREIGN PATENT DOCUMENTS

| | | |
|---|---|---|
| EP | 2581656 A2 | 4/2013 |
| EP | 2719938 A1 | 4/2014 |

(Continued)

OTHER PUBLICATIONS

Italian Search Report (7 pages) based on application No. TO 2014000442 dated Sep. 10, 2014 (for reference purpose only).

*Primary Examiner* — Bao Q Truong

(74) *Attorney, Agent, or Firm* — Viering, Jentschura & Partner mbB

(57) ABSTRACT

A lighting device may include a light radiation source board carrying at least one electrically powered light radiation source, e.g. a LED source, and a frame-like housing having a window, the board of the light radiation source being arranged in the housing with the light radiation source facing window.

A glass cover covering the window is inserted in the housing by sliding along the housing or by tilting against the housing.

9 Claims, 4 Drawing Sheets

(56) References Cited

U.S. PATENT DOCUMENTS

| | | | | |
|---|---|---|---|---|
| 2013/0039047 | A1* | 2/2013 | Kim | F21L 4/02 362/184 |
| 2014/0104856 | A1* | 4/2014 | Lamonato | F21V 19/0055 362/362 |
| 2015/0369469 | A1* | 12/2015 | Vamberi | F21S 8/022 362/153.1 |

FOREIGN PATENT DOCUMENTS

| | | | |
|---|---|---|---|
| WO | 2006049086 | A1 | 5/2006 |
| WO | 2012156870 | A1 | 11/2012 |

* cited by examiner

LIGHTING DEVICE

CROSS-REFERENCE TO RELATED APPLICATION

This application claims priority to Italian Patent Application Serial No. TO2014A000442, which was filed Jun. 3, 2014, and is incorporated herein by reference in its entirety.

TECHNICAL FIELD

Various embodiments may generally relate to lighting devices.

Various embodiments may refer to lighting devices employing LED sources as light radiation sources.

BACKGROUND

In designing lighting devices, e.g. by employing solid-state light radiation sources such as LED radiation sources, the need may arise to protect the device against the outer environment (e.g. in terms of Ingress Protection or IP).

Various implementations may envisage, as a protection element, a protection screen of a plastic material. This solution, however, may not be able to meet the flammability requirements imposed by some international standards, or the need to ensure good optical properties (essentially the transparency to light radiation) during the lifetime of the product.

In order to meet such requirements one may resort to glass covers (e.g. screens); besides being advantageously inexpensive, such covers may offer good protection features against electrical shocks and as regards flammability.

The use of glass covers also offers other advantages, e.g. the possibility of an easy removal of the glass protection cover in order to permit maintenance or replacement with a different cover having different optical properties (e.g. as regards diffusion, transparency, colour, scattering of the light radiation and so on).

The need may moreover be felt to make the mounting process of the lighting device quick and easy, without degrading other properties such as:

- the possibility of achieving a good protection (e.g. IP-grade) level in a stable and reliable mounting structure (also as regards thermal stresses),
- device ventilation, so as to offer stable and reliable luminous flux properties, and/or
- the possibility of combining several lighting devices in arrays.

SUMMARY

Various embodiments allow the achievement of one or more of the following advantages:

- possibility of an easy and quick replacement of the (e.g. LED) lighting device in an outer housing,
- interchangeability of the glass cover which protects the light radiation emitting source without the need to loosen screws, regardless of the arrangement of the cover mounting mechanism inside or outside the housing,
- uniform contact pressure between the light engine and the mounting surface, adapted to be implemented as a thermally dissipative surface, so as to dissipate the heat developed during operation,
- air ventilation around the light radiation sources, which may be achieved e.g. through features of the housing,

- protection against the penetration of environmental agents (e.g. IP grade),
- easy and quick mounting of the whole device and of the related lighting system.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

In the following description, numerous specific details are given to provide a thorough understanding of one or more exemplary embodiments. The embodiments may be practiced without one or several specific details, or with other methods, components, materials, etc. In other instances, well-known structures, materials, or operations are not shown or described in detail to avoid obscuring various aspects of the embodiments. Reference throughout this specification to "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment.

Furthermore, particular features, structures, or characteristics may be combined in any suitable manner in one or more embodiments. By way of non-limiting example, the implementation details exemplified in FIG. 9 may be applied in the same way to the various embodiments exemplified in the other Figures.

The headings provided herein are for convenience only, and therefore do not interpret the scope or meaning of the embodiments.

In the Figures, reference 10 denotes as a whole a lighting device which may employ, as a light radiation source, one or more electrically powered light radiation sources, e.g. solid-state light radiation sources such as LED sources.

Figure 2:
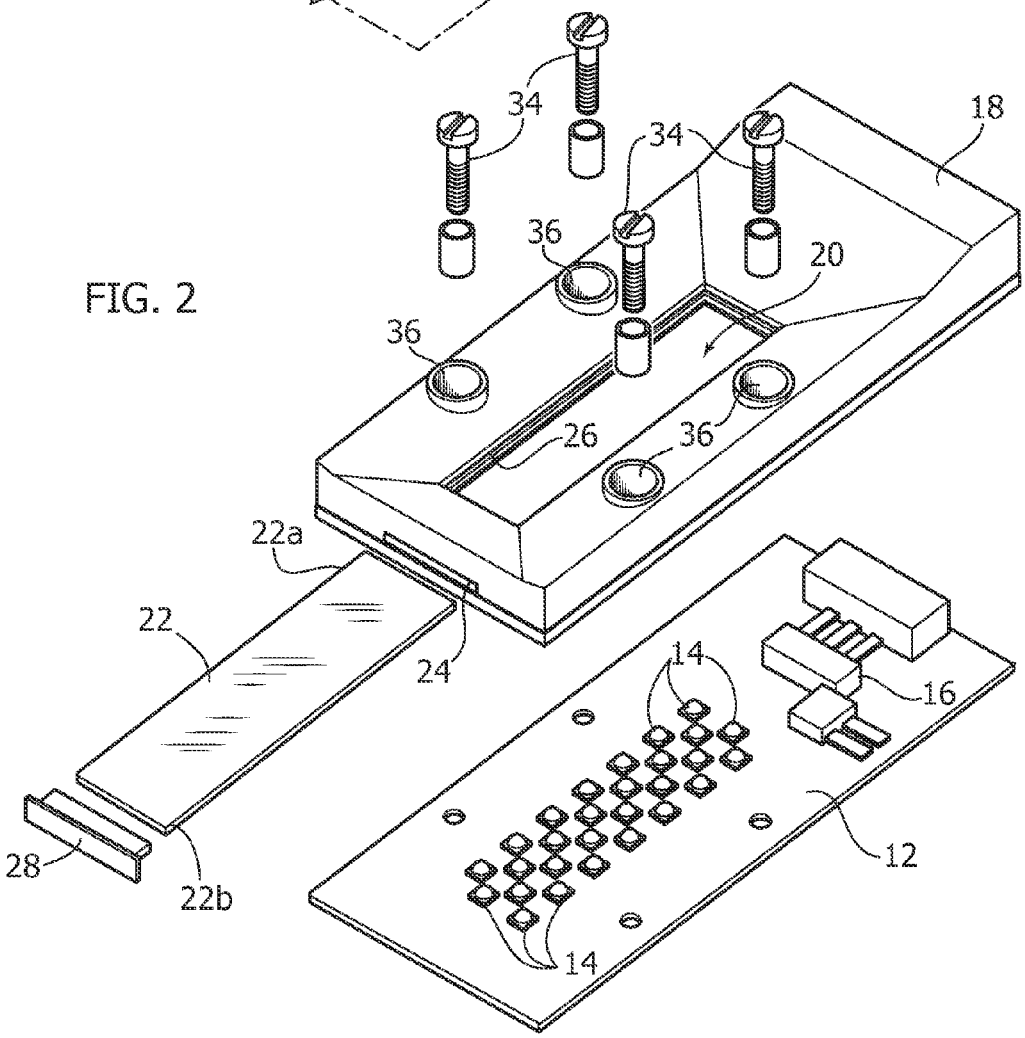
FIG. 2 is an exploded perspective view of the device in FIG. 1.
Figure 6:
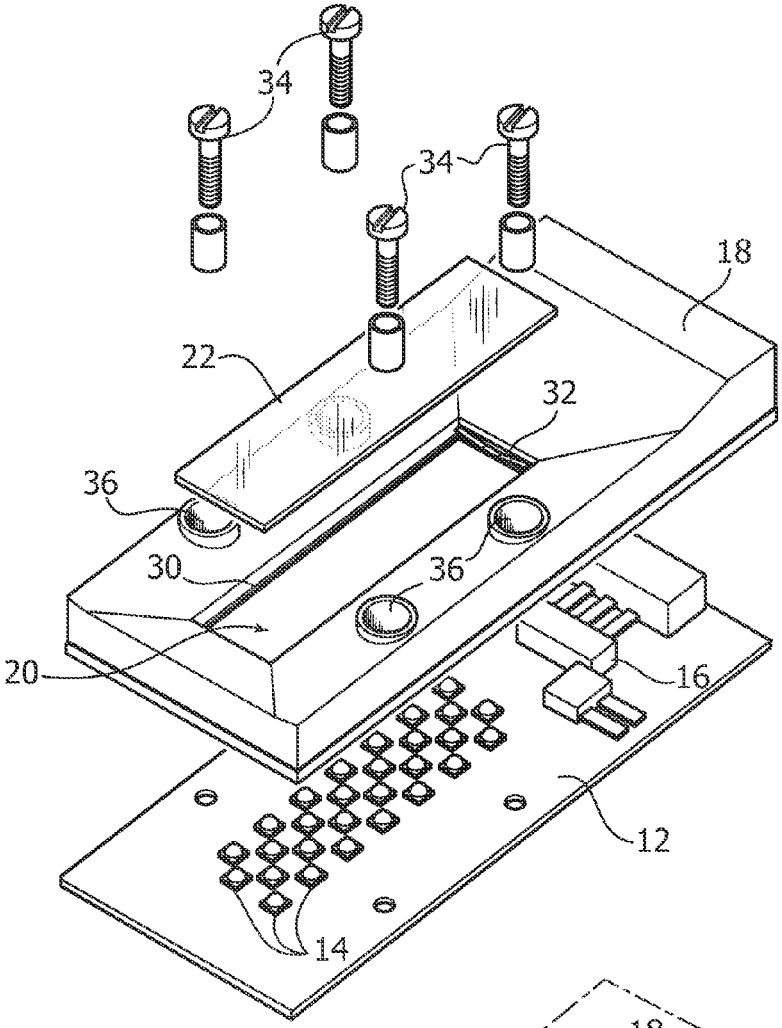
FIG. 6 is an exploded perspective view of the device of FIG. 5.

The exploded perspective views of FIG. 2 and of FIG. 6 highlight the possible presence, in various embodiments, of a board 12 which mounts a light radiation source 14.

In various embodiments, light radiation source 14 may include an array, e.g. a generally rectangular array, of LED light radiation sources.

In various embodiments, board 12 may substantially similar to a PCB (Printed Circuit Board). In various embodiments, board 12 may also support electric/electronic circuits 16 adapted to perform a power feed function and, optionally, a control function of the light radiation source(s) 14.

The implementation criteria of such light radiation sources and of the associated circuits are largely known and therefore do not require a detailed description herein.

Board 12 with the light radiation source(s) 14 and, optionally, the related circuits 16 mounted thereon is adapted to be arranged in a housing 18, so as to enable the mounting of device 10 onto a mounting surface S, such as for example a wall, an item of interior furnishing etc.

In various embodiments, housing 18 may be made e.g. of a moulded material such as a plastic material or a lightweight metal (e.g. aluminium), optionally with thermal dissipation features.

In various embodiments, housing 18 may have a general frame-like shape, with an opening 20 forming a sort of window facing the source(s) 14: the light radiation produced by such sources can therefore propagate outside housing 18 through window 20.

In various embodiments, opening or window 20 may have a shape at least approximately complementary to the shape of light radiation source 14. For example, in various embodiments as exemplified in the Figures, the LED array which constitutes the light radiation source has a quadrilateral shape (e.g. square or rectangular) and window 20 has therefore a corresponding quadrilateral shape, e.g. square or rectangular.

The choice of such a shape, of course, is not mandatory insofar as source 14, window 20 and cover 22 may have different shapes, such as circular, polygonal, mixtilinear, etc.

In various embodiments, window 20 may be formed in a lowered portion of the front face of housing 10, i.e. of the face or side of housing 18 which, once the lighting device 10 has been mounted on mounting surface S, is opposed to such a surface.

In various embodiments, on the opening or window 20 there may extend a cover 22 adapted to be made e.g. of a plate of glassy material, in the following simply named "glass", which is inserted (fitted or stuck) into housing 18, so as to close the housing and provide protection (e.g. IP-grade) features to light radiation source 14 mounted on board 12 and to the circuits 16 optionally associated thereto.

For example, in one or more embodiments the front side or face of housing 18 may have, at least in the portion surrounding opening 20, a general vat-like shape, wherein the glass covering 22 is arranged at the bottom.

In various embodiments, covering 22 is permeable to light radiation, with the following ability to form a transparent protective screen of source(s) 14.

In various embodiments as exemplified in FIGS. 1 to 4, cover 22 may be inserted slidingly into housing 18 through a slot 24, which is provided in housing 18 and is aligned with the contour of opening 20.

Figure 3:
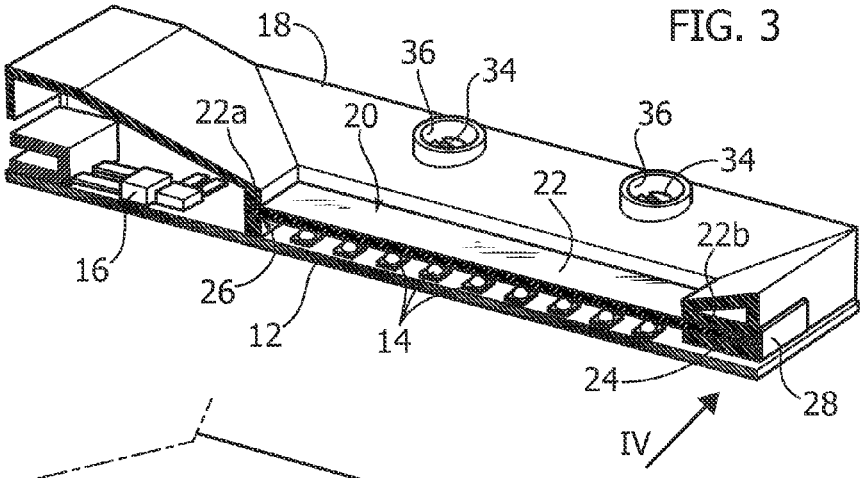
FIG. 3 is a partial section view of a device as exemplified in FIGS. 1 and 2.

In various embodiments, the contour of opening 10 may have longitudinal side grooves 26 (and possibly bottom grooves, see FIG. 3), wherein cover 22 may be inserted and may slide along housing 18 until reaching a final insertion position in housing 18 (which is exemplified in FIG. 3).

Figure 4:
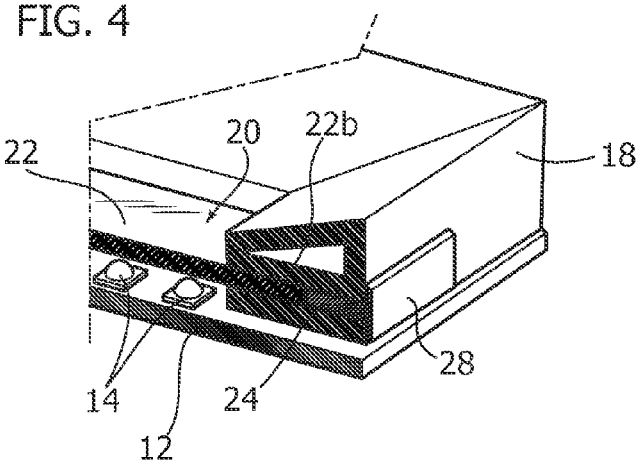
FIG. 4 is an enlarged view of the part in FIG. 3 denoted by arrow IV.

In various embodiments, cover 22 may have:

- a distal end 22*a*, adapted to penetrate within housing 18 and to slide along housing 18 until cover 22 closes opening 20, and
- a proximal end 22*b*, adapted to remain in a peripheral position with respect to housing 18 (see FIG. 4).

In the final insertion position in housing 18 (see FIGS. 3 and 4), grooves 26 and the external edge of cover 22 inserted in such grooves form a sort of labyrinth, which is adapted to "seal" cover 22 with housing 18, so as to achieve a protection (e.g. of IP grade) of light radiation source 14 and of the elements associated thereto.

In various embodiments, such action of sealing closure may be complemented, at the proximal end 22*b* of cover 22, by a gasket 28 inserted into slot 24; gasket 28 may therefore act as a sort of plug which closes slot 24, completing the sealing action and protecting housing 18 towards the outer environment.

Figure 7:
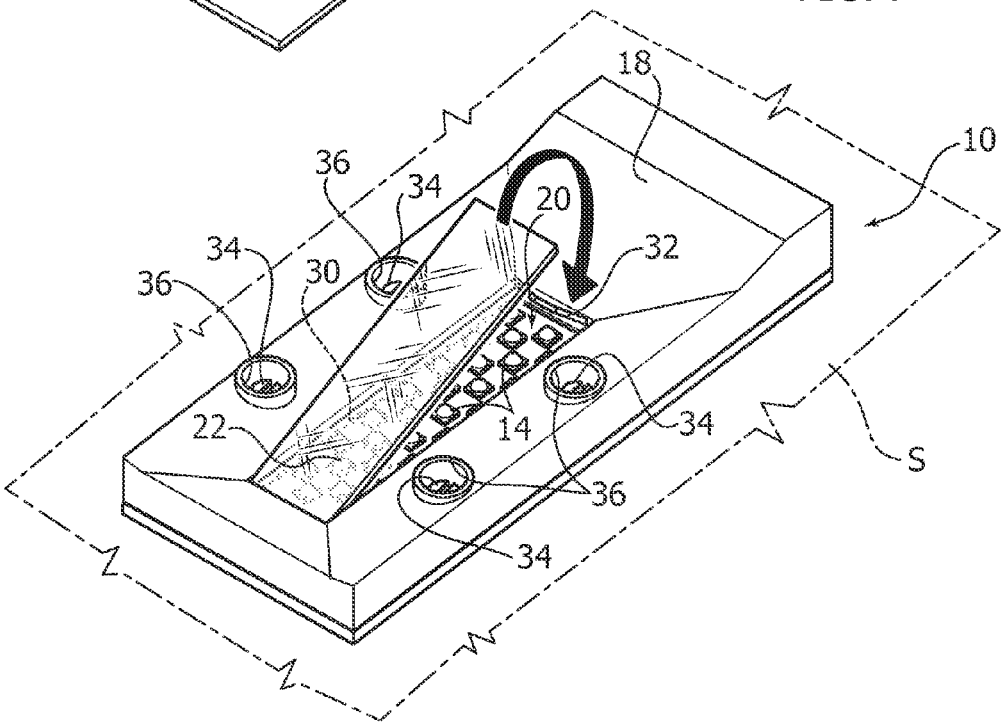
FIG. 7 shows features of the lighting device of FIGS. 5 and 6.
Figure 8:
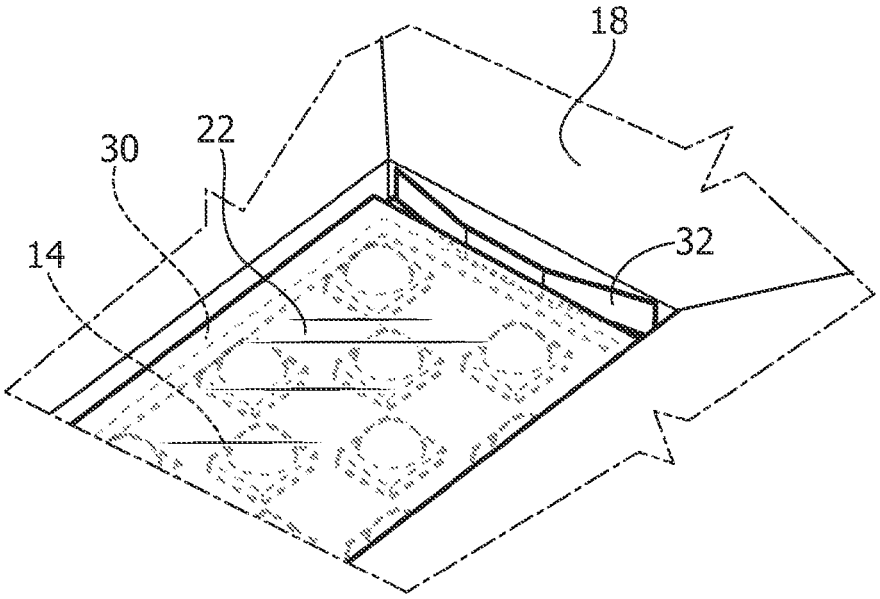
FIG. 8 shows an enlarged view of the part in FIG. 5 denoted by arrow VIII.

In various embodiments as exemplified in FIGS. 5 to 8, cover 22 may be inserted into housing 18 by blocking it in housing 18 through a tilting action, which may take place as shown in FIG. 7.

In such a case, along the contour of opening 20 there may be present a frame edge 30, against which cover 22 may abut (e.g. after the tilting movement exemplified in FIG. 7), i.e. by initially contacting a side (e.g. one of the shorter sides) of cover 22 along a corresponding portion of the frame edge 30 of opening 20, and then by tilting cover 22 so as to bring it into abutment with the frame edge 30, therefore obtaining a sort of labyrinth that achieves a sealing action of opening 20 by cover 22.

Cover 22 may be kept in the position of sealing opening 20, e.g., by elastic means such as a spring 32 (e.g. a leaf or flat spring) arranged along one of the sides of opening 22 (e.g. one of the shorter sides of the opening) with the function of urging cover 20 against the peripheral edge of opening 20, achieving the sealing closure thereof.

Whatever the embodiments, in order to fix the lighting device 10 on the mounting surface S one may resort for example to a fixing by screws, e.g. with screws passing through holes 36 formed in housing 18, e.g. along the contour of opening 20.

The fixing mechanism of device 10 on surface S may therefore be made totally independent from the mounting mechanism of cover 22 which closes opening 20.

This may be achieved either by mounting cover 22 from within housing 18 (e.g. according to the embodiments exemplified in FIGS. 1 to 4, the glass cover 22 being inserted into housing 18 by sliding along housing 18 itself), or by mounting cover 22 by operating outside housing 18 (e.g. according to the embodiments exemplified in FIGS. 5 to 8, the glass cover 22 being inserted into housing 18 by tilting against housing 18 itself).

In this way, in various embodiments, the removal/replacement of cover 22 may be carried out without acting on the screws 34 which fix device 10 on mounting surface S.

Figure 1:
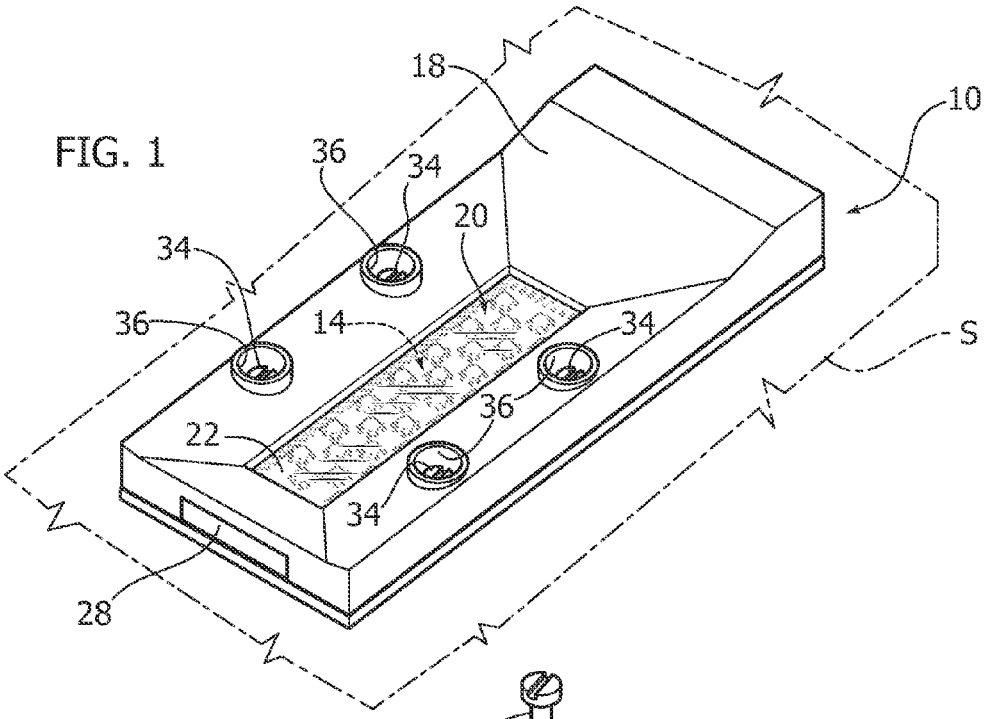
FIG. 1 is a perspective view of a lighting device according to various embodiments.
Figure 5:
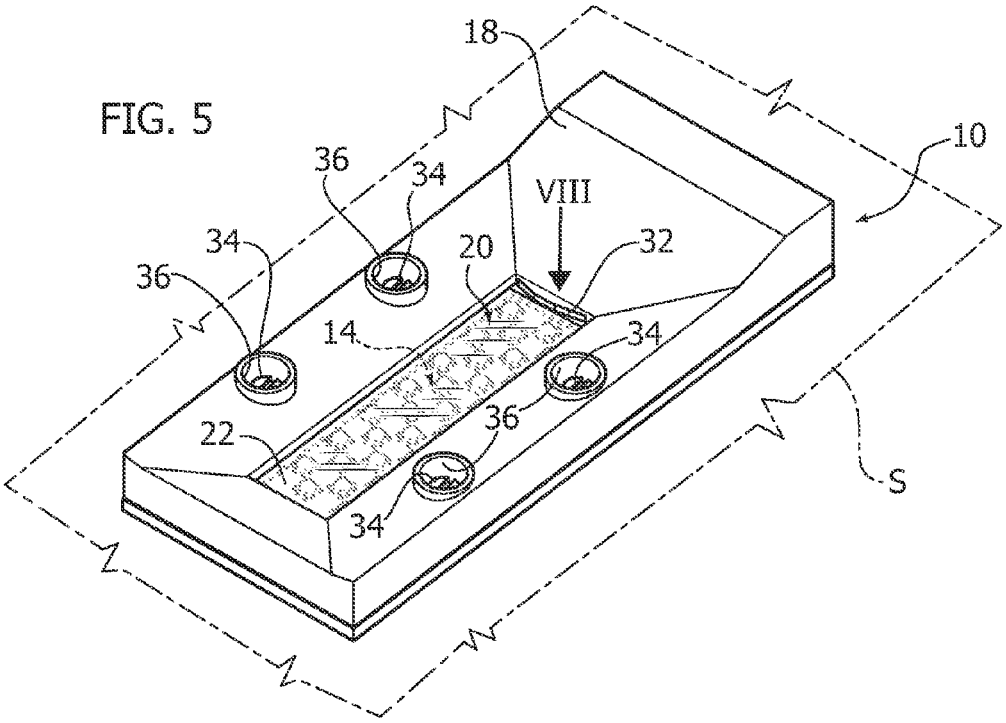
FIG. 5 is a perspective view of a lighting device according to various embodiments.
Figure 9:
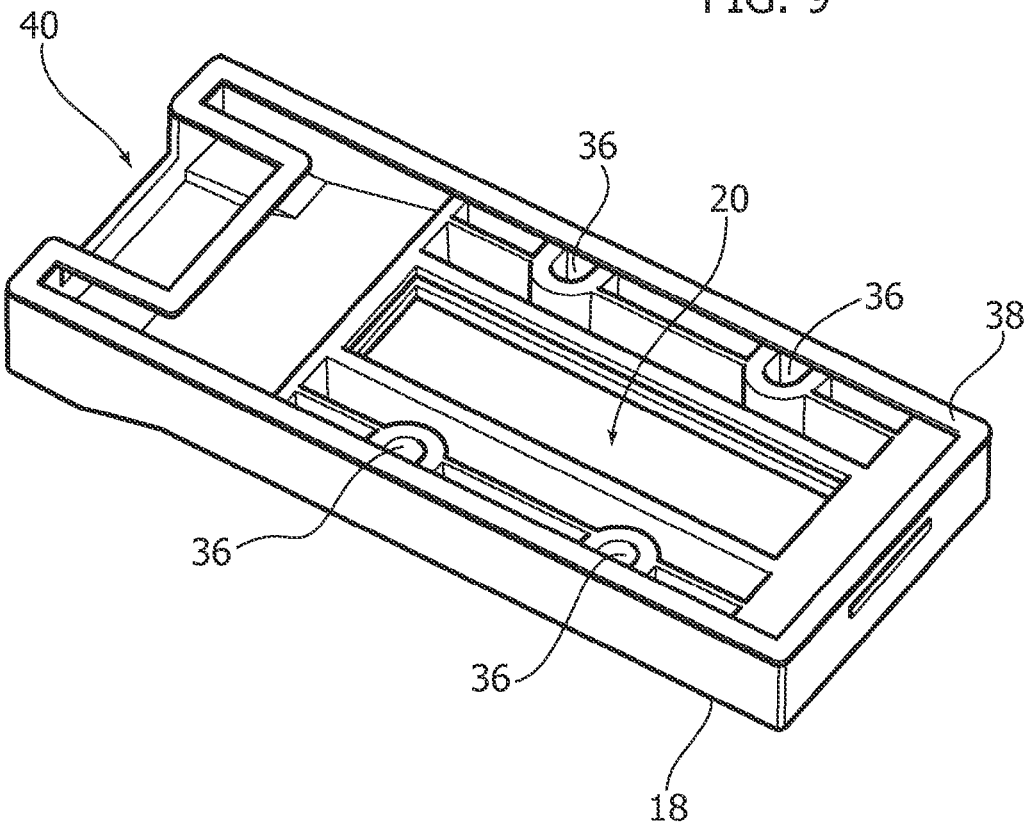
FIG. 9 is a perspective view according to a viewpoint opposed to the one of FIGS. 1 and 5, exemplifying features which may be present in the various presently exemplified embodiments.

The perspective view of FIG. 9 (which corresponds to a viewpoint which is opposed to the viewpoints of FIGS. 1 and 5) exemplifies the possibility to arrange, on the back face of housing 10, i.e. on the side of the housing which faces mounting surface S, a gasket (e.g. a peripheral gasket) 38 which is adapted to achieve a sealed closure between housing 18 and surface S, while ensuring the protection of the interior of housing 18 (e.g. of light sources 14 and of the elements associated thereto) against the penetration of environmental agents.

At the same time, the ventilation features of housing 18 are not jeopardized, with a consequent dissipating action of the heat generated in operation.

In various embodiments, housing 18 may have a flat shape, and/or an end depression 40 (see for example FIG. 9, showing features which may be used in any exemplified embodiment) for inserting an electric connector adapted to achieve a contact with circuits 16 arranged on board 12.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lighting device, comprising:

a light radiation source board with at least one electrically powered light radiation source, a frame-like housing having a window therein, the light radiation source board arranged in said housing with said at least one light radiation source facing said window, and a cover of a light permeable glass material inserted in said housing and covering said window, wherein said window is formed in a lowered portion of the front face of said housing, said front face having, in a portion surrounding said window a vat-like shape with said glass material cover arranged at the bottom, and holes for fixing screws are formed in said housing in said portion surrounding said window.

2. The lighting device of claim 1, wherein said glass material cover is inserted in said housing by sliding insertion along said housing.

3. The lighting device of claim 2, further comprising a gasket coupled at a proximal position to said glass material cover for providing a sealed closure of said housing.

4. The lighting device of claim 1, wherein said glass material cover is inserted in said housing by tilting against said housing.

5. The lighting device of claim 1, further comprising an elastic member acting on said glass material cover by urging it in a seat formed in said housing.

6. The lighting device of claim 1, wherein:

said frame-like housing has a front face wherein said window is provided and a back side for mounting onto a mounting surface, and a gasket is provided on said back side for sealingly mounting said housing onto said mounting surface.

7. The lighting device of claim 1, wherein said window and said glass material cover have a quadrilateral shape.

8. The lighting device of claim 1, wherein said at least one electrically powered light radiation source includes a LED light radiation source.

9. The lighting device of claim 1, wherein said window and said glass material cover have rectangular or square shape.

* * * * *